US011585104B2

(12) United States Patent
Mikic

(10) Patent No.: US 11,585,104 B2
(45) Date of Patent: Feb. 21, 2023

(54) FORMWORK SUPPORT COMPRISING A HOLLOW PROFILE WEB, STIFFENED BY AN INTERNAL FRAMEWORK, AS A FLANGE CONNECTOR

(71) Applicant: PERI SE, Weissenhorn (DE)

(72) Inventor: Erzad Mikic, Karlsruhe (DE)

(73) Assignee: PERI SE, Weissenhorn (DE)

( * ) Notice: Subject to any disclaimer, the term of this patent is extended or adjusted under 35 U.S.C. 154(b) by 37 days.

(21) Appl. No.: 16/982,932

(22) PCT Filed: Mar. 20, 2019

(86) PCT No.: PCT/EP2019/056937
§ 371 (c)(1),
(2) Date: Sep. 21, 2020

(87) PCT Pub. No.: WO2019/180067
PCT Pub. Date: Sep. 26, 2019

(65) Prior Publication Data

US 2021/0010280 A1 Jan. 14, 2021

(30) Foreign Application Priority Data

Mar. 20, 2018 (DE) ..... 102018204201.2

(51) Int. Cl.

| | |
|---|---|
| ***E04G 11/50*** | (2006.01) |
| ***E04C 3/08*** | (2006.01) |
| *E04C 3/292* | (2006.01) |
| *E04C 3/04* | (2006.01) |

(52) U.S. Cl.
CPC ..... *E04G 11/50* (2013.01); *E04C 3/08* (2013.01); *E04C 3/292* (2013.01); *E04C 2003/0456* (2013.01); *E04G 2011/505* (2013.01)

(58) Field of Classification Search
CPC . E04G 11/50; E04G 2011/505; E04G 11/483; E04G 11/486; E04G 11/38; E04G 11/48; E04G 11/52; E04G 11/56; E04C 3/08; E04C 3/292; E04C 2003/0456
USPC ..... 52/839; D25/122, 124
See application file for complete search history.

(56) References Cited

U.S. PATENT DOCUMENTS 2,092,472 A * 9/1937 Rafter ..... E04C 3/292 52/634
2,129,625 A * 9/1938 Rafter ..... E04C 3/292 52/841
3,737,964 A * 6/1973 Jury ..... B21D 47/02 29/6.1
4,169,304 A * 10/1979 Binder ..... B29D 99/0003 264/46.7

(Continued)

FOREIGN PATENT DOCUMENTS

CN 101558209 A 10/2009
CN 202227583 5/2012

(Continued)

*Primary Examiner* — Michael Safavi
(74) *Attorney, Agent, or Firm* — Wei & Sleman LLP

(57) ABSTRACT

A formwork support for supporting concrete formworks in the construction sector, comprising an upper flange and a lower flange, which are connected to one another via a hollow profile web such that they are at an invariant distance in relation to one another, wherein the hollow profile web is stiffened inside by framework struts.

13 Claims, 5 Drawing Sheets

(56) References Cited

U.S. PATENT DOCUMENTS

| | | | | | |
|---|---|---|---|---|---|
| 4,580,380 | A * | 4/1986 | Ballard | E04C 3/29 | 52/309.9 |
| 4,843,777 | A * | 7/1989 | Shimabukuro | E04C 3/29 | 52/841 |
| 4,974,384 | A * | 12/1990 | Pacione | E04F 13/0882 | 52/483.1 |
| 5,625,996 | A * | 5/1997 | Bechtel | E04C 3/18 | 52/843 |
| 8,813,926 | B2 * | 8/2014 | Tanaka | B64C 1/062 | 244/119 |
| 2004/0031230 | A1 * | 2/2004 | Pabedinskas | E04C 3/28 | D25/119 |
| 2006/0070340 | A1 * | 4/2006 | Fanucci | E04C 3/29 | 52/837 |
| 2007/0107367 | A1 * | 5/2007 | Kermani | E04C 3/14 | 52/837 |
| 2008/0202067 | A1 * | 8/2008 | Wall | E04C 2/384 | 52/839 |
| 2009/0249742 | A1 | 10/2009 | Liddell | | |

FOREIGN PATENT DOCUMENTS

| | | | | | |
|---|---|---|---|---|---|
| DE | 2707573 | A1 * | 8/1978 | E04C 3/08 | |
| DE | 19724361 | A1 * | 1/1998 | B29C 44/24 | |
| DE | 29918827 | | 2/2000 | | |
| DE | 102013109790 | B4 * | 8/2015 | E04C 3/07 | |
| EP | 0094246 | A2 * | 11/1983 | E04G 11/50 | |
| EP | 0577096 | A1 * | 1/1994 | E04C 3/08 | |
| FR | 1100070 | A * | 9/1955 | E04C 3/292 | |
| FR | 1402064 | A * | 6/1965 | E04C 3/292 | |
| FR | 1433511 | A * | 4/1966 | E04C 3/292 | |
| FR | 2842848 | A1 * | 1/2004 | E04G 11/38 | |
| GB | 2253223 | | 9/1992 | | |
| GB | 2428697 | A * | 2/2007 | E04C 3/07 | |
| GB | 2436335 | A * | 9/2007 | E04B 5/48 | |
| KR | 20060004054 | A * | 1/2006 | E04G 11/50 | |
| KR | 20060041382 | A * | 5/2006 | E04G 11/50 | |
| KR | 20090004755 | U * | 5/2009 | E04G 11/50 | |
| RU | 52423 | U1 | 3/2006 | | |
| WO | WO-2013004594 | A1 * | 1/2013 | E04C 3/29 | |

* cited by examiner

FORMWORK SUPPORT COMPRISING A HOLLOW PROFILE WEB, STIFFENED BY AN INTERNAL FRAMEWORK, AS A FLANGE CONNECTOR

FIELD OF THE INVENTION

The present invention relates to a formwork support comprising a hollow profile web, stiffened by an internal framework, as a flange connector

BACKGROUND OF THE INVENTION

In the construction sector, so-called formwork supports are used to support wall, ceiling and column formworks. The formwork supports are usually in the form of a flanged beam and therefore have an upper flange and a lower flange which are permanently connected to one another via a flange connector or web. In conventional designs, the web is wholly made of solid wood or wood materials or, in order to save weight, is designed as a framework. The formwork supports generally have only limited weather resistance and dimensional stability, especially since water absorption causes the material to swell and shrink.

More recently, formwork supports have become known, from construction practice, in which the web (flange connector) is in the form of a simple extruded hollow profile made of aluminum. Although formwork supports of this kind are distinguished by further weight savings and improved weather resistance and thus service life, they often do not have a sufficiently great capacity for handling loads. For demanding formwork tasks, for example in exposed concrete construction, an excessively high number of formwork supports of this kind therefore has to be used, inter alia, which is time, labor and cost intensive.

SUMMARY OF THE INVENTION

The problem addressed by the invention is therefore that of providing a formwork support which is both cost-effective to manufacture and has an improved service life at the same time as improved load-handling capacity. This problem is solved by a formwork support. Preferred embodiments of the invention can be found in the dependent claims and in the description.

The formwork support according to the invention is substantially characterized in that the upper and the lower flange of the formwork support are connected to one another via a hollow profile web so as to be at an invariant distance relative to one another, which web is stiffened on the inside thereof by framework struts. The hollow profile web, which is being used as a flange connector, thus has an interior space divided into chambers by framework struts. By means of the framework struts inside the hollow profile web, the load-handling capacity of the formwork support, in particular the transverse shear stiffness thereof, can be increased in a simple and cost-effective manner. The higher transverse shear stiffness, load-bearing capacity and flexural rigidity of the formwork support according to the invention mean that fewer formwork supports, steel chords or ceiling supports are required in both wall and ceiling formworks. The mass of the formwork support and the material costs of the formwork support are only slightly increased by the framework struts, and therefore the formwork support is easy to handle in practice. As a result of the hollow profile web being formed as one piece, the formwork support can be generated cost-effectively and in a largely automated manner. The formwork support according to the invention is also distinguished by improved longevity by comparison with conventional formwork supports comprising a flange connector made of wood. It should also be noted that the formwork support can be easily recycled once it has reached its maximum service life.

From a manufacturing perspective, the flange connector or hollow profile web is preferably, according to the invention, in the form of a metal extruded profile or in the form of a plastics extrusion profile. This offers cost advantages, in particular for mass production of the formwork support. The plastics extrusion profile can be made of a plastics composite material. Fiber composite materials are also conceivable in this case, which can comprise further aggregates as required. Aggregates include in particular carbon, for example graphite, aggregates which improve the UV resistance of the material, and color pigments by means of which the hollow profile web can be colored, in particular in a warning color.

According to the invention, a strut framework having one or more posts can be formed by the framework struts, which post(s) is/are each arranged so to as extend orthogonally with respect to one of the lateral walls of the hollow profile web. This can increase the load-handling capacity and the torsional rigidity of the formwork support in a particularly reliable manner. Framework struts which are arranged so as to extend diagonally between the lateral walls of the hollow profile web can each form an angle $\alpha$ with the lateral walls of the hollow profile web, where $\alpha \leq 45°$.

The upper and/or the lower flange of the formwork support can, according to the invention, each have a flange body which is designed as a separate component to the hollow profile web and which is fastened, in particular screwed, preferably in a detachable manner, to the hollow profile web. The flange body can in this case advantageously be made of a different material to the hollow profile web. The flange body can therefore, according to the invention, be made at least in part, preferably completely, of wood, a wood material or a plastics material. As a result, the nailability of the upper and/or lower flange comprising the flange body can be ensured. Fastening a formwork element (e.g. form panel) which forms the form lining to the formwork support can also be further simplified as a result.

According to the invention, each flange body can in particular be supported on and fastened to laterally projecting support profiles of the hollow profile web in an axial direction with respect to the vertical axis of the formwork support. From a manufacturing perspective, the support profiles are preferably (integrally) formed on the hollow profile web.

The aforementioned flange body and the hollow profile web can, according to a preferred embodiment of the invention, engage in one another in the direction of the vertical axis of the formwork support, preferably over the entire longitudinal extent of the hollow profile web. As a result, the flange body can extend over the hollow profile web on three sides thereof. This offers even greater improved protection of the hollow profile web against damage, in particular when the hollow profile web is made of metal. Particularly permanent and durable fastening of the flange body to the hollow profile web can also be achieved as a result.

According to an alternative embodiment of the invention, the flange body of the upper and/or the lower flange can be formed in multiple parts. In this case, the flange body has at least a first and a second flange body segment. The two flange body segments each preferably rest at least laterally against the hollow profile web.

The flange body segments of the upper and/or lower flange can, according to the invention, each be screwed, riveted, adhered and/or hooked to the hollow profile web.

According to a particularly preferred embodiment of the invention, the hollow profile web extends over the entire overall height H of the formwork support. A particularly flexurally and torsionally rigid formwork support can thus be achieved.

According to an alternative embodiment of the invention, the upper and the lower flange of the formwork support can be integrally formed on the hollow profile web. In this design, the whole formwork support can be formed as one piece and in particular designed as a metal, in particular aluminum, extruded profile or as a plastics extrusion profile. Said plastics extrusion profile preferably comprises fiber aggregates. Constructing the formwork support from a single material means that recycling said formwork support can be simplified further.

The hollow profile web can have closed or substantially closed lateral walls. In the latter case, the lateral walls can comprise so-called system bores, for example, which in practice are used to conduct manufacturer-specific or manufacturer-independent attachments or the like therethrough.

According to an alternative embodiment of the formwork support, the hollow profile web has through-recesses arranged so as to be spaced apart from one another in the direction of the longitudinal extent thereof, such that the hollow profile web forms a framework having framework profiles (=framework struts) which are integrally connected to one another. The whole formwork support is thus designed as a framework support. The ease of handling of the formwork support can thus be improved, while maintaining sufficient load-handling capacity of the formwork support, and the lightweight construction requirements required in practice are again better achieved. The through-recesses can, according to the invention, each have a polygonal, in particular triangular, shape, or can be designed as round recesses. The through-recesses can in this case be arranged on the hollow profile web so as to be at least partially offset from one another in height. The framework profiles are preferably each arranged so as to extend obliquely with respect to the upper and to the lower flange at an acute angle $\beta$. According to the invention, the angle $\beta$ is preferably $\beta>45°$.

The hollow profile web can, according to the invention, be foamed at least in portions, preferably completely. When the foam used is designed in a corresponding manner, the load-handling capacity of the formwork support can be increased even further, without the mass of the formwork support increasing in excess of the costs. Moreover, undesired permeation of impurities and moisture into the hollow profile web can also be counteracted in operational use and during transport and mounting. A risk of injury when handling the formwork support can also be reduced as a result.

Further advantages of the invention can be found in the description and the drawings. The embodiments shown and described are not to be understood as an exhaustive list, but are instead of an exemplary nature for describing the invention.

DETAILED DESCRIPTION

Figures 1, 2:
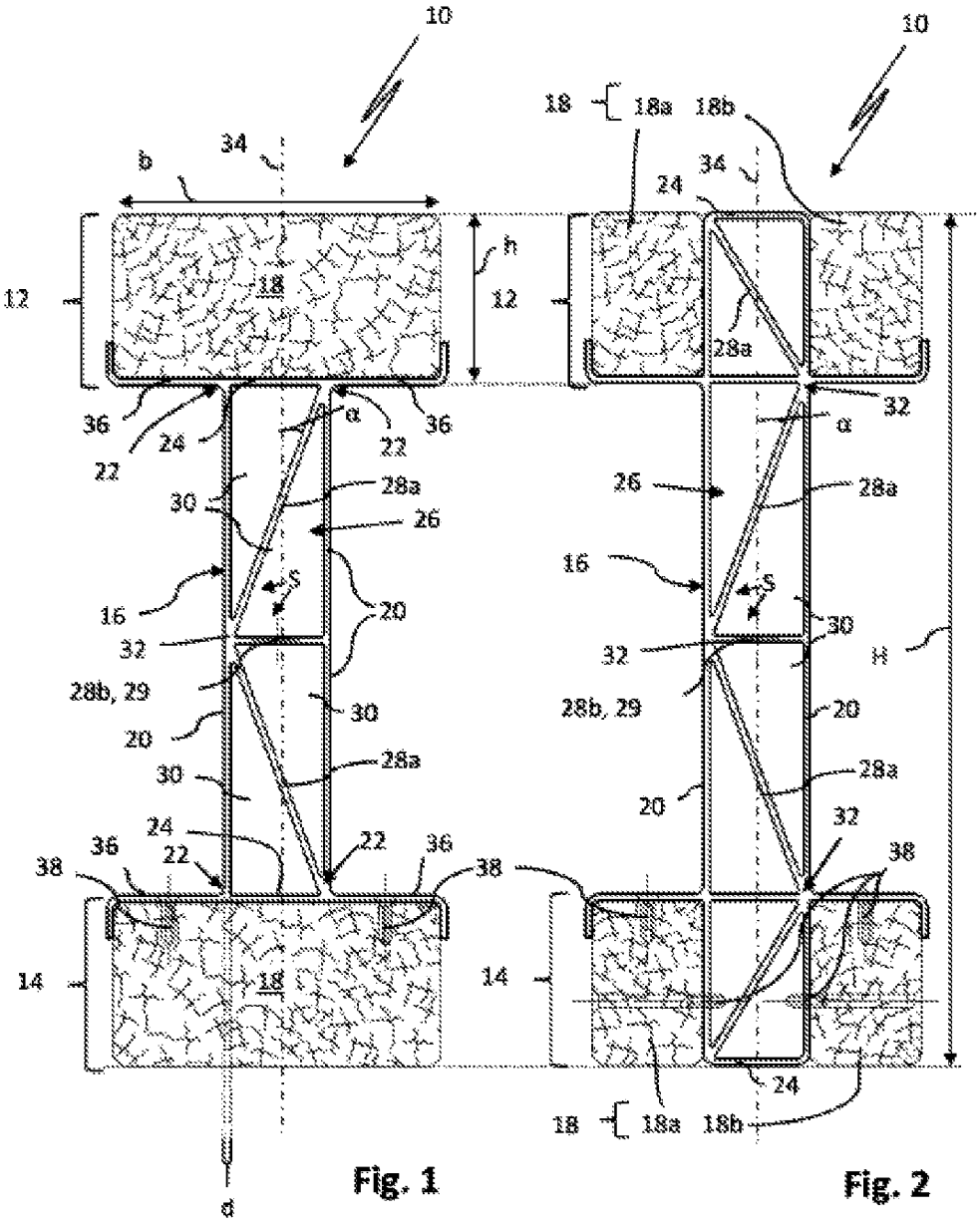
FIG. 1 is a sectional view of a formwork support having an upper flange and a lower flange which are connected to one another via a hollow profile web used as a flange connector, the hollow profile web being stiffened on the inside by framework struts.
FIG. 2 is a sectional view of a formwork support in which the upper flange and the lower flange have a multi-part flange body having two flange body segments in each case, which segments are arranged on both sides of the hollow profile web.

FIG. 1 is a cross-sectional view of a first embodiment of a formwork support 10 according to the invention, which can be used in the construction sector to support a formwork, for example a ceiling formwork for establishing a ceiling in fresh concrete construction. The formwork support 10 has an upper flange 12 and a lower flange 14, which are arranged so as to extend in parallel with one another. The upper flange 12 and the lower flange 14 are permanently connected to one another via a flange connector in the form of a single hollow profile web 16. The hollow profile web 16 is formed as one piece. The upper flange 12 and the lower flange 14 can be constructed identically and in this case each has a rectangular cross-sectional shape.

According to FIG. 1, the two flanges 12, 14 each have precisely one flange body 18 which is separate from the hollow profile web 16. The flange body 18 is made of a differential material to the hollow profile web and can in particular be made of wood, a fiber composite material or a plastics material. A thermoplastic polymer or so-called polymer blend are particularly suitable as the plastics material. Altogether, simplified nailability of the flanges 12, 14 can be ensured as a result.

The hollow profile web 16 is in this case designed as an extruded profile made of aluminum. Alternatively, the hollow profile web 16 can also be designed as an extrusion profile made of a plastics material or a plastics composite material. As a result, the hollow profile web 16 can be generated cost-effectively and with low manufacturing tolerances.

The hollow profile web 16 has two first lateral walls 20 arranged spaced apart from one another. The two first lateral walls 20 are arranged so as to extend in parallel with one another and are mechanically connected to one another at both ends in corner regions 22 via (comparatively shorter) second lateral walls 24. The first and second lateral walls 20, 24 thus enclose an interior space of the hollow profile web, which interior space is denoted by reference sign 26.

According to FIG. 1, the hollow profile web 16 is stiffened on the inside by framework struts 28*a*, 28*b*. At least some of the framework struts 28*a*, 28*b* can, according to FIG. 1, form a so-called strut framework S having transverse posts 29. The transverse posts 29 are each formed by the framework strut which is denoted by reference sign 28*b* and is arranged so as to extend orthogonally to the first lateral walls 20. The interior space 26 of the hollow profile web 16 is divided into individual chambers 30 by the framework struts 28*a*, 28*b*. The chambers 30 are thus delimited from one another by the framework struts 28*a*, 28*b*. Node regions of the framework struts 28*a*, 28*b* are denoted by reference sign 32.

The framework struts 28*a* extend away from the relevant node region 32 in a diagonal direction, i.e. at an acute angle $\alpha$ with respect to the vertical axis 34 of the formwork support 10.

In order to support and fasten the relevant flange body 18 of the upper flange 12 and lower flange 14 to the hollow profile web 16, lugs or profile extensions 36 of the hollow profile web 16 are used which project away laterally outward over the first lateral walls 20 of the hollow profile web 16 in a direction orthogonal to the vertical axis 34 of the formwork support 10. The profile extensions 36 and the second lateral walls 24 can each be arranged at the same height along the vertical axis 34.

The flange bodies 18 are each screwed to the hollow profile web 16 by means of screws 38. Alternatively or additionally, the flange bodies 18 can be arranged so as to be kept adhered, riveted and/or locked to the hollow profile web 16.

The first and second lateral walls 20, 24, the framework struts 28*a*, 28*b* and the profile extensions 36 can have a uniform thickness d or differ from one another in thickness d. The framework struts 28*a*, 28*b* preferably have a smaller thickness d than the lateral walls 20, 24 of the hollow profile web 16.

The upper flange 12 and the lower flange 14 can, for example, have a preferably uniform overall height h of (approximately) 40 millimeters to 60 millimeters and a width b of approximately 80 millimeters. The overall height of the formwork support 10 is denoted in FIG. 1 by reference sign H. It is understood that the proportions of the upper and lower flange and of the hollow profile web 16 can be selected differently.

FIG. 2 is a cross-sectional view of a further embodiment of a formwork support 10. The flange bodies 18 of the upper flange 12 and lower flange 14 are in this case each formed as two pieces and therefore comprise two flange body segments 18*a*, 18*b*.

Contrary to the hollow profile web shown in FIG. 1, the hollow profile web 16 extends in the direction of the vertical axis 34 of the formwork support 10 over the entire height H of the formwork support 10.

As a result, the hollow profile web 16 is arranged in portions between the two flange body segments 18*a*, 18*b* of the upper and of the lower flange 12, 14. The flange body segments each rest against one of the profile extensions and the inner sides of said segments rest against the hollow profile web 16. The flange body segments 18*a*, 18*b* can in this case also each be screwed to the hollow profile web 16 by means of screws 38 and/or arranged so as to be kept adhered, riveted and/or locked to the hollow profile web. The hollow profile web is also stiffened on the inside, in the region of the upper and lower flange, by framework rods 28*a*.

Figure 3:
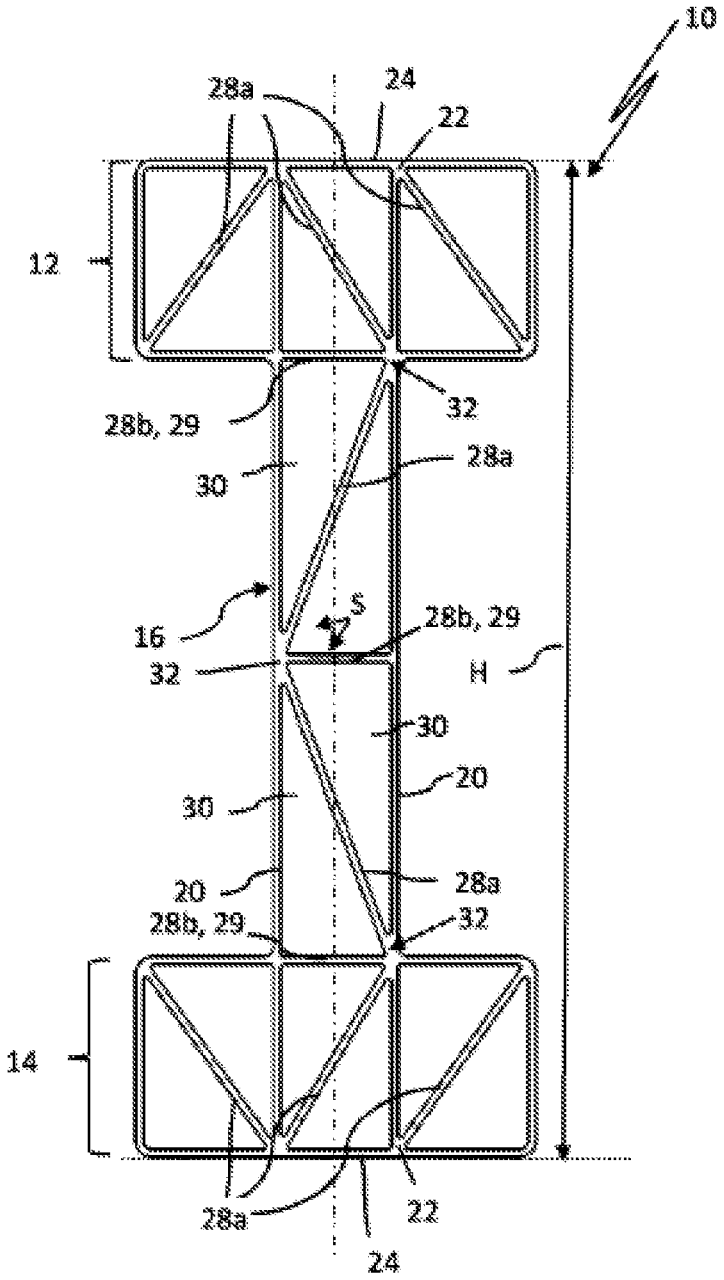
FIG. 3 is a sectional view of a formwork support formed as one whole piece.

FIG. 3 shows a formwork support 10 which is formed as one piece as a metal, in particular aluminum, extruded profile. The upper and the lower flange 12, 14 of the formwork support 10 are each formed on the hollow profile web 16 and themselves stiffened with framework struts 28*a*. If the hollow profile web 16 is completely metal, the upper and lower flange 12, 14 are not nailable or only nailable to a limited degree. The formwork support can therefore also be designed as a whole as an all-plastics formwork support 10 which is preferably designed as a plastics extrusion profile.

In the formwork supports described with regard to FIGS. 1 to 3, the hollow profile web 16 can extend over the entire length L or almost over the entire length of the formwork support 10.

Figure 4:
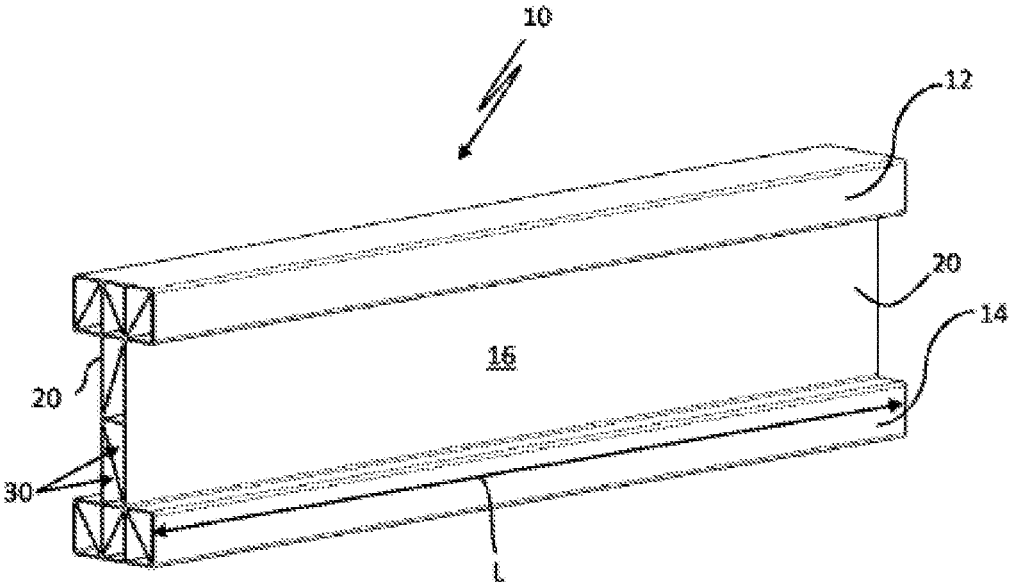
FIG. 4 is a lateral view of a first embodiment of a formwork support according to FIG. 1 or 2, in which the hollow profile web has closed lateral walls.

According to FIG. 4, the hollow profile web 16 of the formwork supports 10 described previously with regard to FIGS. 1 to 3 can comprise closed first lateral walls 20. If the lateral walls 20 comprise individual through-bores for conducting manufacturer-specific or manufacturer-independent system components therethrough, the first lateral walls 20 are considered to be substantially closed.

Figure 5:
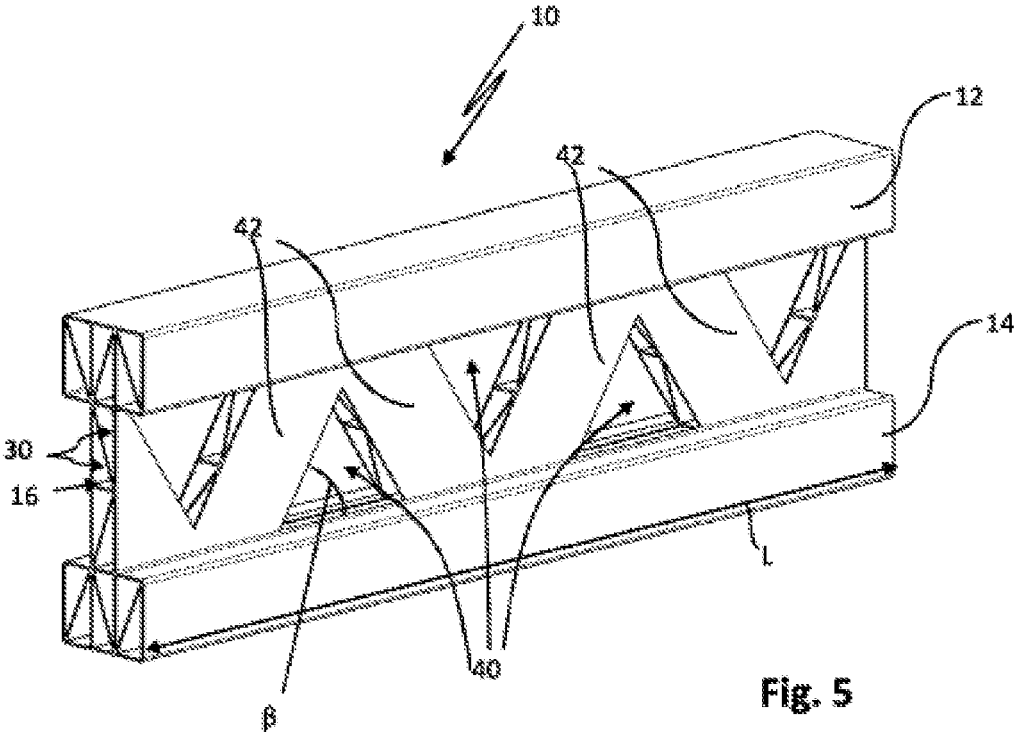
FIG. 5 is a lateral view of a formwork support in which the hollow profile web forms a plurality of framework profiles which are arranged in a row one behind the other in the longitudinal direction of the formwork support.

For further increased ease of handling of the formwork support 10, the hollow profile web 16 can, according to FIG. 5, also comprise a plurality of cutouts or through-recesses 40 which (completely) pass through the hollow profile web 16 transversely to the longitudinal extent thereof. The through-recesses 40 can, for example, be milled from the material of the hollow profile web 16 or cut free from the material of the hollow profile web 16, for example by means of laser cutting. Altogether, the mass of the formwork support 10 can thus be reduced and material costs can be saved. The lightweight construction requirements put on formwork supports 10 in practice can thus be taken into consideration more simply. It should be noted that the through-recesses 40 can be used by the user as engagement openings or in order to attach a crane gear or the like. Some of the chambers 30 of the hollow profile web 16 are interrupted at intervals in the longitudinal direction of the hollow profile web 16 by the through-recesses 40. The through-recesses 40 can be shaped in order to optimize the inherent weight and the load-handling capacity of the formwork support 10 and can be arranged along the formwork support 10 such that the hollow profile web 16 forms framework profiles 42 in the direction of the longitudinal axis L of the formwork support 10. These framework profiles 42 are in this case advantageously each arranged so as to extend obliquely with respect to the upper flange 12 and to the lower flange 14 at an acute angle $\beta$.

Figure 6:
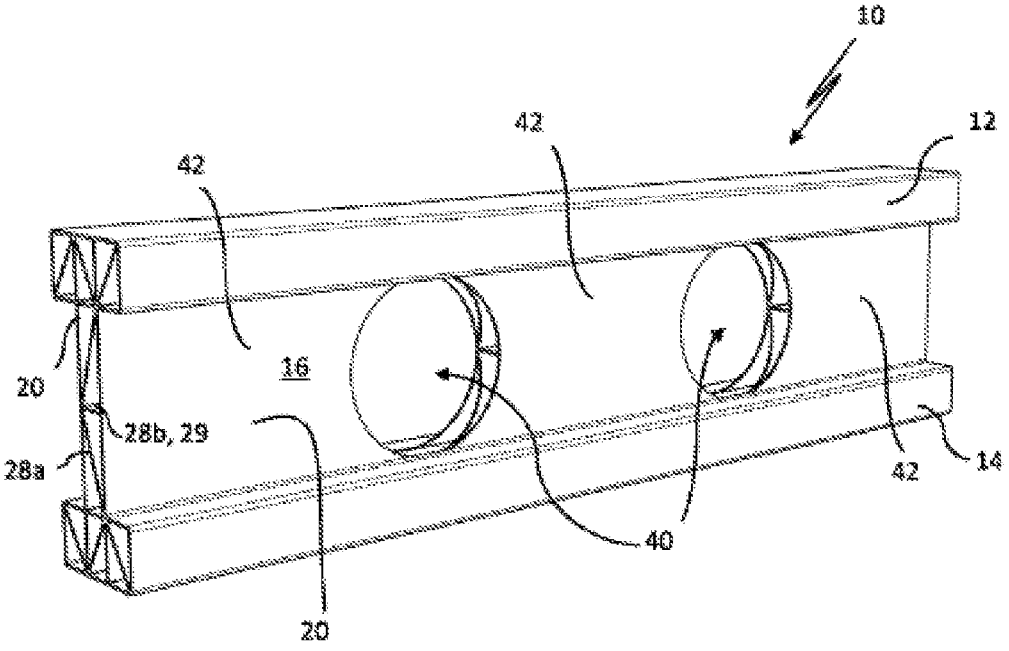
FIG. 6 is a perspective view of a formwork support in which the hollow profile web has a plurality of circular through-recesses which each extend from the upper flange to the lower flange and are arranged so as to be spaced apart in a row one behind the other in the longitudinal direction of the formwork support.
Figure 7:
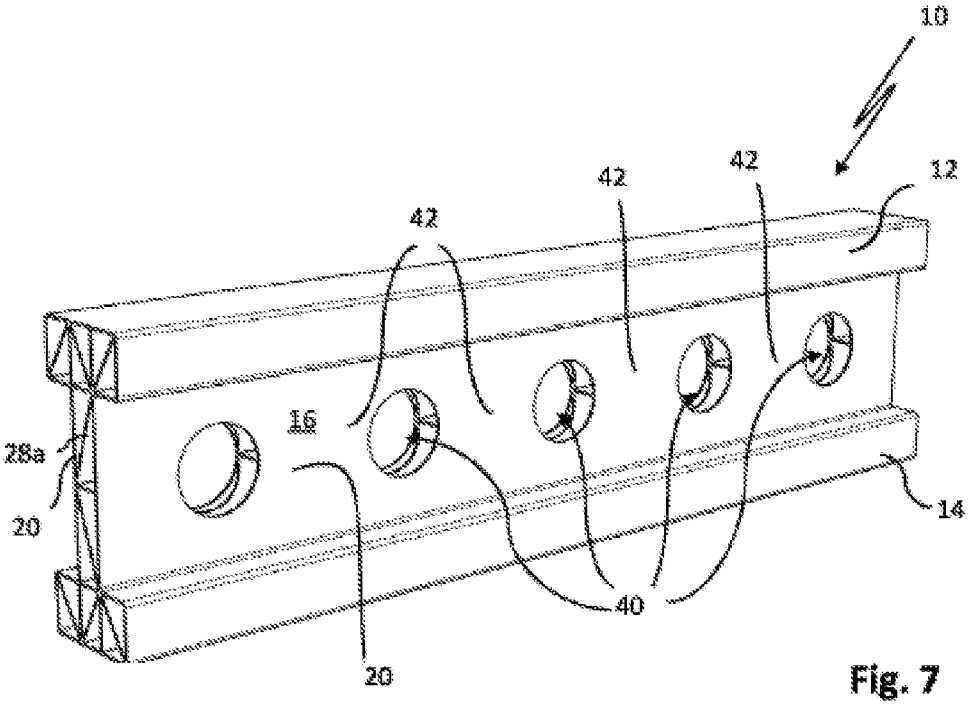
FIG. 7 is a perspective lateral view of a formwork support in which the hollow profile web has smaller through-recesses by comparison with the formwork support according to FIG. 6.
Figure 8:
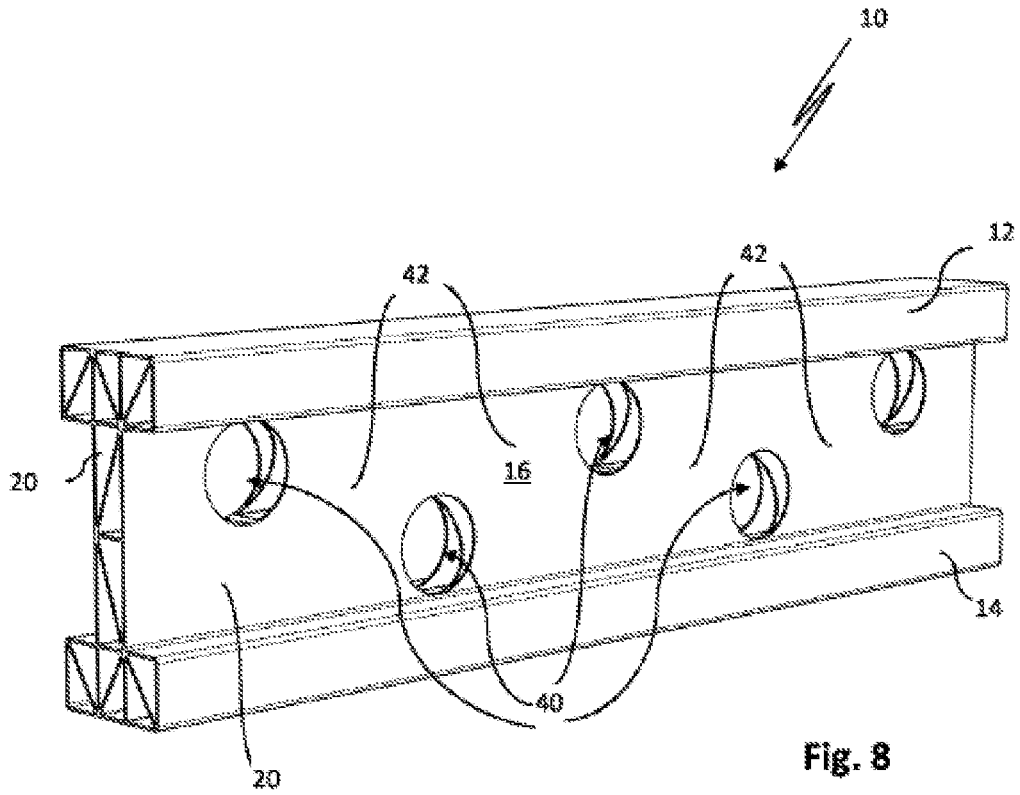
FIG. 8 is a perspective view of a formwork support in which the through-recesses are arranged on the hollow profile web in a plurality of rows, i.e. arranged so as to be alternately offset from one another in height in the longitudinal direction of the formwork support.

For even further improved ease of handling of the formwork support 10, the hollow profile web 16 can, according to the embodiments shown in FIGS. 6 to 8, also comprise a plurality of circular through-recesses 40, i.e. round recesses, which are arranged so as to be spaced apart in a row one behind the other along the formwork support 10. The through-recesses can in this case each be arranged at the same height, as shown in FIGS. 6 and 7, or can be arranged so as to be offset from one another in height, preferably alternately. The through-recesses 40 preferably each have a matching opening cross section. The through-recesses can also each have a different, for example elliptical, cross-sectional shape. For circular or elliptical through-recesses of the hollow profile web, the advantages described above with regard to the embodiment according to FIG. 5 apply equally.

The framework profiles 44 are each integrally connected to one another on the upper flange side and on the lower flange side. The hollow profile web 16 can be foamed at least in portions or completely. As a result, the penetration of dirt can be counteracted and the material thickness of the hollow profile web 16 can optionally be further reduced.

The invention claimed is:

1. A formwork support for supporting concrete formworks in the construction sector, comprising an upper flange and a lower flange which are connected to one another via a hollow profile web so as to be at an invariant distance relative to one another, wherein the hollow profile web is stiffened on the inside thereof by framework struts, wherein first framework struts of the framework struts form a strut framework having transverse posts which are arranged so to as extend orthogonally with respect to two lateral walls of the hollow profile web that are arranged opposite one another and second framework struts of the framework struts extend away from a node region of the framework struts in a diagonal direction.

2. The formwork support according to claim 1, wherein the hollow profile web is designed in the form of a metal extruded profile or in the form of a plastics extrusion profile.

3. The formwork support according to claim 1, wherein the upper and the lower flange of the formwork support each have a flange body which is designed as a separate component to the hollow profile web and which is detachably fastened to the hollow profile web.

4. The formwork support according to claim 3, wherein the flange body is made at least in part of wood, a wood material, or a plastics material.

5. The formwork support according to claim 3, wherein the flange body is supported on and/or fastened in each case to a laterally projecting profile extension of the hollow profile web in an axial direction with respect to the vertical axis of the formwork support.

6. The formwork support according to claim 3, wherein the flange body is formed in multiple parts and has in each case a first and a second flange body segment which each rest laterally against the hollow profile web.

7. The formwork support according to claim 1, wherein the hollow profile web extends over an entire overall height of the formwork support.

8. The formwork support according to claim 3, wherein the flange body and the hollow profile web engage in one another in the direction of the vertical axis of the formwork support over the entire longitudinal extent of the hollow profile web.

9. The formwork support according to claim 1, wherein the upper and the lower flange of the formwork support are integrally formed on the hollow profile web.

10. The formwork support according to claim 1, wherein the hollow profile web has closed or substantially closed lateral walls or in that the hollow profile web has a plurality of through-recesses, such that the hollow profile web forms, in the direction of the longitudinal extent thereof, framework profiles which are integrally connected to one another.

11. The formwork support according to claim 10, wherein the framework profiles are each arranged so as to extend obliquely with respect to the upper flange and to the lower flange at an acute angle $\beta$, where the angle $\beta$ is preferably: $\beta>45°$.

12. The formwork support according to claim 1, wherein the hollow profile web is completely foamed.

13. A formwork support for supporting concrete formworks in the construction sector, comprising an upper flange and a lower flange which are connected to one another via a hollow profile web so as to be at an invariant distance relative to one another, wherein the hollow profile web is stiffened on the inside thereof by framework struts, wherein the framework struts comprise a framework strut which is arranged to extend orthogonally with respect to two lateral walls of the hollow profile web that are arranged opposite one another and a further framework strut which extends away from a node region of the framework struts in a diagonal direction.

* * * * *